US011850841B2

(12) United States Patent
Katakura et al.

(10) Patent No.: US 11,850,841 B2
(45) Date of Patent: Dec. 26, 2023

(54) LIQUID EJECTING APPARATUS

(71) Applicant: SEIKO EPSON CORPORATION, Tokyo (JP)

(72) Inventors: Takahiro Katakura, Okaya (JP); Toshiro Murayama, Fujimi-Machi (JP)

(73) Assignee: Seiko Epson Corporation, Tokyo (JP)

( * ) Notice: Subject to any disclaimer, the term of this patent is extended or adjusted under 35 U.S.C. 154(b) by 89 days.

(21) Appl. No.: 17/454,862

(22) Filed: Nov. 15, 2021

(65) Prior Publication Data

US 2022/0153021 A1 May 19, 2022

(30) Foreign Application Priority Data

Nov. 17, 2020 (JP) ..... 2020-190758

(51) Int. Cl.
*B41J 2/045* (2006.01)
*B41J 2/14* (2006.01)

(52) U.S. Cl.
CPC ..... *B41J 2/04571* (2013.01); *B41J 2/04581* (2013.01); *B41J 2/14233* (2013.01)

(58) Field of Classification Search
CPC ..... B41J 2/04571; B41J 2/04581; B41J 2/14233; B41J 2002/14354; B41J 2202/12; B41J 2/04588
See application file for complete search history.

(56) References Cited

U.S. PATENT DOCUMENTS

2015/0077463 A1* 3/2015 Hosokawa ..... B41J 2/14274 347/19
2015/0258780 A1 9/2015 Hayashi

FOREIGN PATENT DOCUMENTS

JP 2004-351704 A 12/2004
JP 5482336 B 2/2014
JP 6287387 B 2/2018

* cited by examiner

*Primary Examiner* — Lisa Solomon
(74) *Attorney, Agent, or Firm* — WORKMAN NYDEGGER

(57) ABSTRACT

A liquid ejecting apparatus has: a liquid discharge section configured to change an inner volume of a first pressure chamber communicating with a nozzle by a first piezoelectric element; a pressure vibration section configured to change an inner volume of a second pressure chamber by a second piezoelectric element; a driving signal generation section configured to generate a discharging driving signal for the first piezoelectric element and a detection driving signal for the second piezoelectric element; and a vibration detection section that detects residual vibration of a liquid filled in the second pressure chamber after the supply of the detection driving signal. The viscous resistance of a flow path between the second pressure chamber and the common flow path is lower than the viscous resistance of a flow path between the first pressure chamber and the common flow path.

7 Claims, 9 Drawing Sheets

LIQUID EJECTING APPARATUS

The present application is based on, and claims priority from JP Application Serial Number 2020-190758, filed Nov. 17, 2020, the disclosure of which is hereby incorporated by reference herein in its entirety.

BACKGROUND

1. Technical Field

The present disclosure relates to, for example, a liquid ejecting apparatus.

2. Related Art

A liquid ejecting apparatus ejects (discharges) a liquid, which is typically an ink, from a nozzle communicating with a pressure chamber by using a piezoelectric element attached to an inner wall of the pressure chamber. The pressure chamber is displaced according to an applied voltage. In the liquid ejecting apparatus, therefore, a pulsed driving signal, for example, is applied to the piezoelectric element to displace the inner wall of the pressure chamber and thereby reduce the inner volume of the pressure chamber. Accordingly, ink filled in the pressure chamber is discharged from the nozzle, after which the ink lands on a medium P. Thus, the liquid ejecting apparatus can form a desired image on the medium P.

In a known technique in a liquid ejecting apparatus in which this type of piezoelectric element is used, a counter electromotive force (residual vibration) generated by the piezoelectric element after a driving signal has been applied is analyzed and the driving signal is corrected accordingly (see JP-A-2004-351704, for example).

In a state in which the viscosity of the liquid is high, residual vibration is rapidly attenuated. This makes it difficult to analyze the residual vibration.

SUMMARY

A liquid ejecting apparatus according to one aspect of the present disclosure has a liquid discharge section having a first pressure chamber, a first piezoelectric element that changes the inner volume of the first pressure chamber, and a nozzle communicating with the first pressure chamber, a pressure vibration section having a second pressure chamber and a second piezoelectric element, a first common flow path communicating with the first pressure chamber and the second pressure chamber, a driving signal generation section that generates a discharging driving signal to be supplied to the first piezoelectric element and a detection driving signal to be supplied to the second piezoelectric element, and a vibration detection section that detects, based on a change in the electromotive force of the second pressure chamber, residual vibration of a liquid filled in the second pressure chamber, the change occurring after the supply of the detection driving signal. The viscous resistance of a flow path between the second pressure chamber and the first common flow path is lower than the viscous resistance of a flow path between the first pressure chamber and the first common flow path.

BRIEF DESCRIPTION OF THE DRAWINGS

FIG. 5 illustrates examples of a detection driving signal and the like.

DESCRIPTION OF EXEMPLARY EMBODIMENTS

Preferred embodiments of the present disclosure will be described below with reference to the drawings. These drawings will be referenced for convenience of explanation. The embodiments described below do not unreasonably restrict the contents of the present disclosure, the contents being described within the scope of the claims. All of the structures described below are not always essential structural requirements.

First Embodiment

Figure 1:
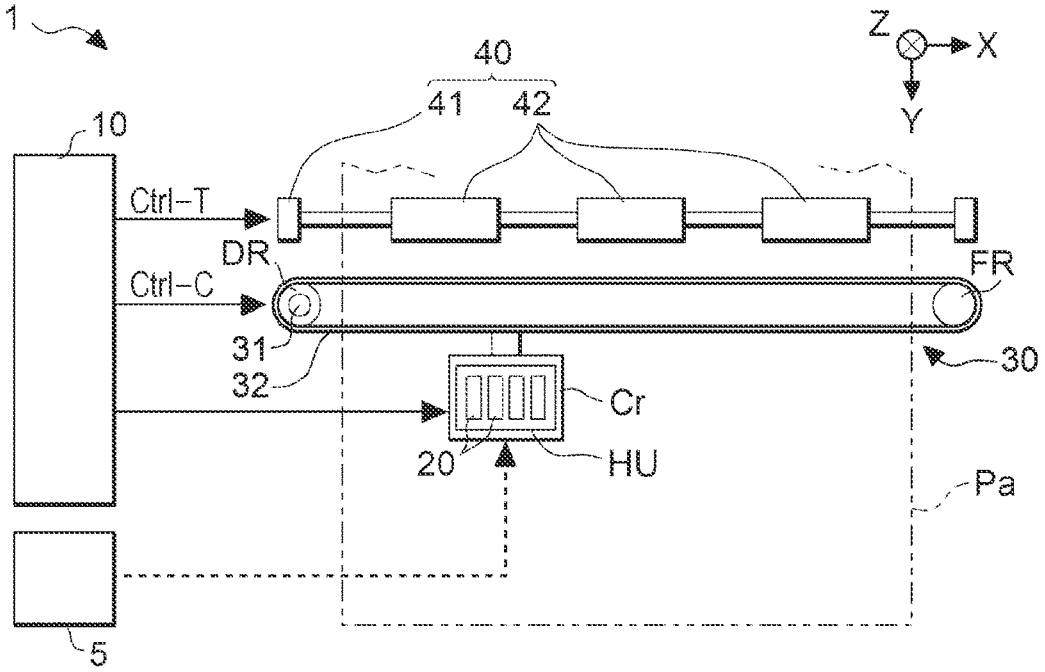
FIG. 1 schematically illustrates the structure of a liquid ejecting apparatus according to a first embodiment.

FIG. 1 schematically illustrates the structure of a liquid ejecting apparatus 1 according to a first embodiment. The liquid ejecting apparatus 1 is an ink jet printer that forms an image on a medium Pa by moving bidirectionally a carriage Cr mounting a head unit HU and discharging ink as an example of a liquid from nozzles formed in the print head 20.

In the description below, it will be assumed that in the drawings the right direction, the direction being one of the directions in which the carriage Cr moves, is the X direction, a direction in which the medium Pa is transported is the Y direction, and a direction in which ink is discharged is the Z direction. It will also be assumed that the X direction, Y direction, and Z direction are mutually orthogonal. A print sheet, a resin film, a piece of fabric, or any other target eligible for printing can be used as the medium Pa.

The liquid ejecting apparatus 1 includes a liquid container 5, a control mechanism 10, the carriage Cr, the head unit HU, a moving mechanism 30, and a transport mechanism 40.

The liquid container 5 holds one or a plurality of types of ink to be discharged toward the medium Pa. Types of ink held in the liquid container 5 include black ink, cyan ink, magenta ink, yellow ink, red ink, gray ink, and inks of other colors. An ink cartridge, a bag-shaped ink pack formed from a flexible film, an ink tank that can be replenished with ink, or the like can be used as the liquid container 5 in which ink is held.

The head unit HU includes one or a plurality of print heads 20. In FIG. 1, four print heads 20 are included in the head unit HU, for convenience of explanation. However, the number of print heads 20 is not limited to 4. It is only necessary that at least one print head 20 be included.

The carriage Cr is fixed to an endless belt 32 included in the moving mechanism 30. However, the liquid container 5 may be mounted in the carriage Cr or may be disposed at a location other than the carriage Cr. The liquid container 5 and head unit HU are coupled to each other by an ink supply tube. Thus, ink held in the liquid container 5 is supplied to the print head 20 in the head unit HU.

To simplify the description, it will be assumed in this embodiment that a single type of ink is supplied to one print head 20.

The control mechanism 10 generates a plurality of control signals used to control elements. Specifically, the control mechanism 10 outputs a control signal Ctrl-C to control the movement of the carriage Cr by the moving mechanism 30, a control signal Ctrl-T to control the transport of the medium Pa by the transport mechanism 40, and various other signals to discharge ink from the print head 20. Signals to the print head 20 will be described later.

The moving mechanism 30 includes a carriage motor 31, the endless belt 32, a driving roller DR, and a follower roller FR. The carriage motor 31 rotates the driving roller DR. The endless belt 32 is tensioned between the driving roller DR and the follower roller FR. The endless belt 32 moves as the carriage motor 31 rotates. When the carriage motor 31 rotates the driving roller DR, therefore, the carriage Cr fixed to the endless belt 32 moves bidirectionally in the X direction and in the direction opposite to the X direction.

Therefore, when the control mechanism 10 outputs the control signal Ctrl-C, the position in main scanning during image formation is controlled.

The transport mechanism 40 includes a transport motor 41 and a transport roller 42. The transport motor 41 operates in response to the control signal Ctrl-T received from the control mechanism 10. The transport roller 42 rotates according to the operation of the transport motor 41.

When the control mechanism 10 outputs the control signal Ctrl-T, therefore, the transport roller 42 rotates and the medium Pa is transported in the Y direction, controlling the position in sub-scanning during image formation.

As described above, in the liquid ejecting apparatus 1, ink is discharged from the print head 20 mounted in the carriage Cr in cooperation with transport of the medium Pa by the transport mechanism 40 and the bidirectional movement of the carriage Cr by the moving mechanism 30. This makes it possible to have ink land on intended positions on the surface of the medium Pa and form a desired image on the medium Pa.

Figure 2:
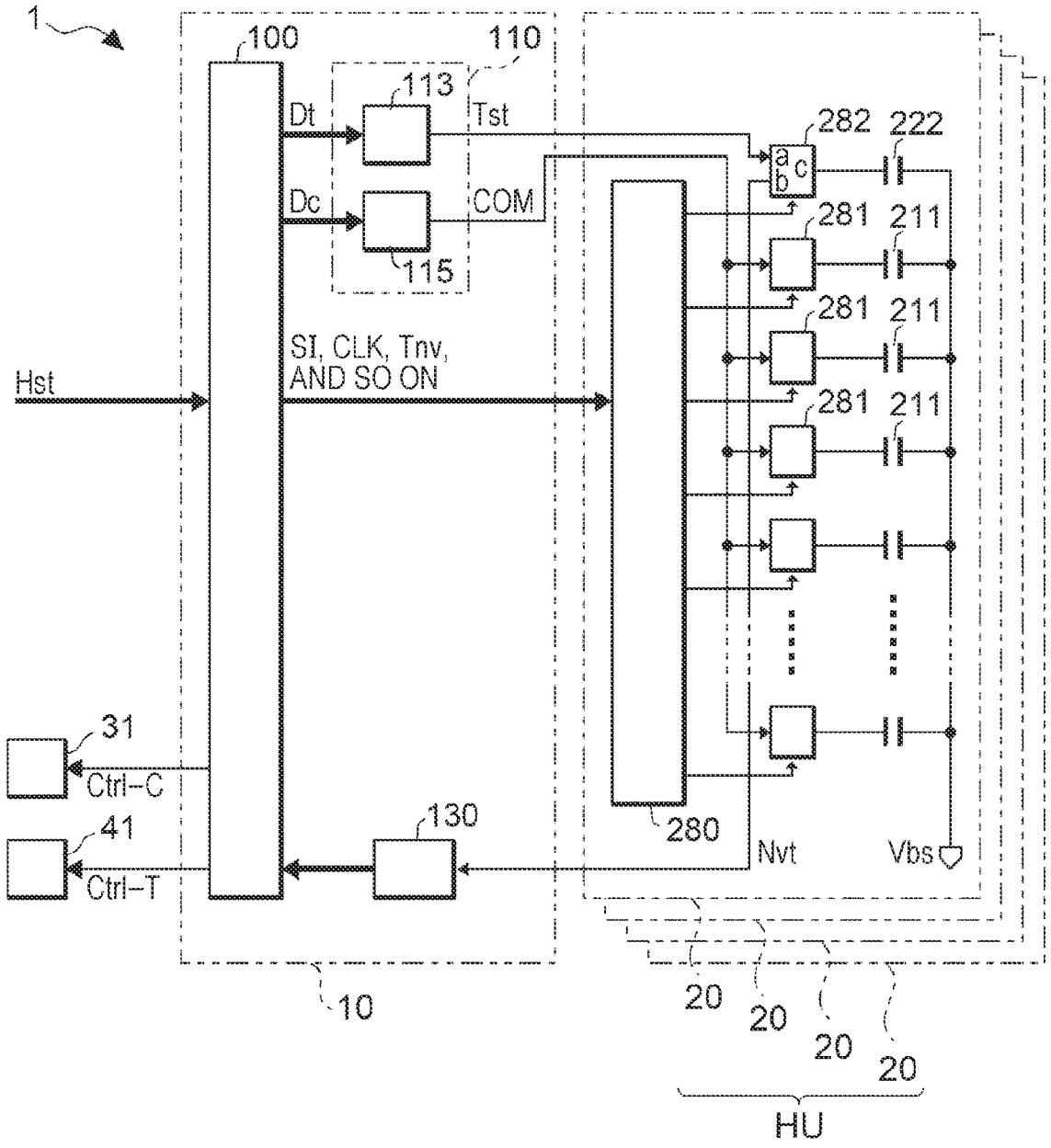
FIG. 2 is a block diagram illustrating the electrical structure of the liquid ejecting apparatus.

FIG. 2 is a block diagram illustrating the electrical structure of the liquid ejecting apparatus 1. The liquid ejecting apparatus 1 includes the control mechanism 10, head unit HU, carriage motor 31, and transport motor 41 described above.

In this embodiment, four print heads 20 are provided in the head unit HU as described above. Although different types of ink may be supplied to the four print heads 20, their structures are substantially the same. Therefore, the description below will focus on one certain print head 20 and explanation of the other print heads 20 will be appropriately omitted.

The control mechanism 10 includes a control section 100, a driving signal generation section 110, and a vibration detection section 130. The control section 100 includes, for example, a processor such as a microcontroller and a storage circuit such as a semiconductor memory. The processor is, for example, a processing circuit such as a central processing unit (CPU) or a field programmable gate array (FPGA). The storage circuit stores waveform data Dt and Dc.

The control section 100 receives various signals Hst such as image data from a host computer (not illustrated), generates, for example, data and signals used to control individual sections from the signals Hst, and outputs the generated signals and data.

The control section 100 acquires a position in main scanning by the head unit HU from a position sensor (not illustrated). The control section 100 then generates various signals according to the acquired position of the head unit HU and outputs the generated signals.

Specifically, the control section 100 generates the control signal Ctrl-C used to control the bidirectional movement of the head unit HU and outputs the control signal Ctrl-C to the carriage motor 31. The control section 100 also generates the control signal Ctrl-T used to transport the medium Pa and outputs the control signal Ctrl-T to the transport motor 41.

In addition, the control section 100 generates various signals used to control the print head 20 according to the signal Hst and the position of the head unit HU, and outputs the generated signals to the print head 20. Each signal used to control the print head 20 includes control data SI that specifies the discharging or non-discharging of ink for each nozzle. As the control data SI, data that specifies the discharging or non-discharging of ink for each nozzle is output serially form according to a clock signal CLK, for example.

The control section 100 outputs a signal Tnv that specifies a start of the detection of residual vibration, which will be described later.

In addition to the control data SI and clock signal CLK, the various signals used to control the print head 20 include signals used to, for example, latch control data SI, but these signals are omitted.

The driving signal generation section 110 includes a detection driving signal generation section 113 and a discharging driving signal generation section 115. The detection driving signal generation section 113 converts the waveform data Dt output from the control section 100 to an analog signal, performs class-D amplification on the converted source signal in analog form, and outputs the resulting signal as a detection driving signal Tst. The discharging driving signal generation section 115 converts waveform data Dc output from the control section 100 to an analog signal, performs class-D amplification on the converted source signal in analog form, and outputs the resulting signal as a discharging driving signal COM.

In this embodiment, the detection driving signal generation section 113 converts waveform data Dt to an analog signal and amplifies the converted signal to generate the detection driving signal Tst. However, an analog signal may be generated from data other than waveform data Dt, and the resulting signal may be used as a source signal of the detection driving signal Tst. Similarly, instead of the discharging driving signal generation section 115 converting the waveform data Dc to an analog signal and amplifying the converted signal to generate the discharging driving signal COM, an analog signal may be generated from data other than the waveform data Dc, and the resulting signal may be used as a source signal of the discharging driving signal COM.

Amplification by the detection driving signal generation section 113 and amplification by the discharging driving signal generation section 115 are not limited to class-D amplification. The amplification may be, for example, class-A amplification, class-B amplification, class-AB amplification, or the like.

After the detection driving signal Tst has been output, the vibration detection section 130 receives a detection signal Nvt output from the print head 20 and detects, based on the detection signal Nvt, residual vibration generated in a pressure chamber in the print head 20. In addition, the vibration detection section 130 analyzes the detected residual vibration and determines the viscosity of ink filled in the pressure chamber. The vibration detection section 130 then outputs information about the viscosity to the control section 100.

The waveforms and the like of the detection driving signal Tst, discharging driving signal COM, and detection signal Nvt will be described later.

The detection driving signal Tst, discharging driving signal COM, control data SI, and the like are supplied from the control mechanism 10 to the focused print head 20, which is one of the four print heads 20 provided in the head unit HU. Furthermore, the detection signal Nvt is supplied from the print head 20 to the vibration detection section 130.

The print head 20 includes m piezoelectric elements 211 used for discharging and a piezoelectric element 222 used for detection. Here, m is an integer more than or equal to 2 and indicates the number of nozzles from which ink is discharged. That is, in this embodiment, the piezoelectric elements 211 are provided in one-to-one correspondence with the nozzles. The structure of the piezoelectric element 222 is substantially the same as the structure of the piezoelectric element 211. In this embodiment, however, the piezoelectric element 222 does not correspond to the nozzles.

The print head 20 includes a splitting circuit 280, m switch circuits 281, and one switch circuit 282.

The splitting circuit 280 latches control data SI for m nozzles and outputs, to the control end of each of the m switch circuits 281 and according to the result of the latch, a signal that specifies whether to switch on or off the switch circuit 281.

The switch circuit 281 brings the electrical coupling between its input end and output end into a switched-on state (conductive state) or a switched-off state (non-conductive state), according to the signal supplied to the control end.

The discharging driving signal COM is supplied to the input end of the switch circuit 281. The output end of the switch circuit 281 is coupled to one of two electrodes of the piezoelectric element 211. The other of the two electrodes of each of the m piezoelectric elements 211 is coupled in common and is held at a voltage Vbs.

In this structure, when the switch circuit 281 is switched on in response to the signal output from the splitting circuit 280, the discharging driving signal COM is applied to the one electrode of the piezoelectric element 211.

When the switch circuit 281 is switched off, the one electrode of the piezoelectric element 211 is placed in a high-impedance state, in which the one electrode is not electrically coupled to any portion. However, since an equivalent circuit of the piezoelectric element 211 is a capacitive element such as a capacitor as illustrated in the drawing, the one electrode of the piezoelectric element 211 is held at a voltage applied immediately before the piezoelectric element 211 is placed in the high-impedance state. This prevents the voltage at the one electrode of the piezoelectric element 211 from becoming unstable.

The splitting circuit 280 outputs, to the control end of the switch circuit 282, a signal that selects a contact "a" when the signal Tnv is at a low level and selects a contact "b" when the signal Inv is at a high level. When the signal Inv changes from low to high, a start of the detection of residual signal is specified.

The switch circuit 282 is a double-throw circuit that couples either the contact "a" or the contact "b" to a contact "c" in response to the signal supplied to the control end. In the switch circuit 282, the detection driving signal Tst is supplied to the contact "a", the contact "b" is coupled to the input end of the vibration detection section 130, and the contact "c" is coupled to one electrode of the piezoelectric element 222. The other electrode of the piezoelectric element 222 is coupled to the other of the two electrodes of each of the m piezoelectric elements 211 in common and is held at the voltage Vbs.

Therefore, when the signal Tnv is at the low level, the detection driving signal Tst is applied to one end of the piezoelectric element 222, after which when the signal Tnv changes to the high level and a start of the detection of residual vibration is thereby specified, a signal resulting from an electromotive force generated in the piezoelectric element 222, specifically a signal indicating residual vibration, is supplied to the input end of the vibration detection section 130 through the switch circuit 282 as the detection signal Nvt.

Regarding the print heads 20 other than the focused print head 20 as well, the control mechanism 10 similarly outputs the detection driving signal Tst, discharging driving signal COM, control data SI, clock signal CLK, and so on to each print head 20 and receives the detection signal Nvt from each print head 20.

Figure 3:
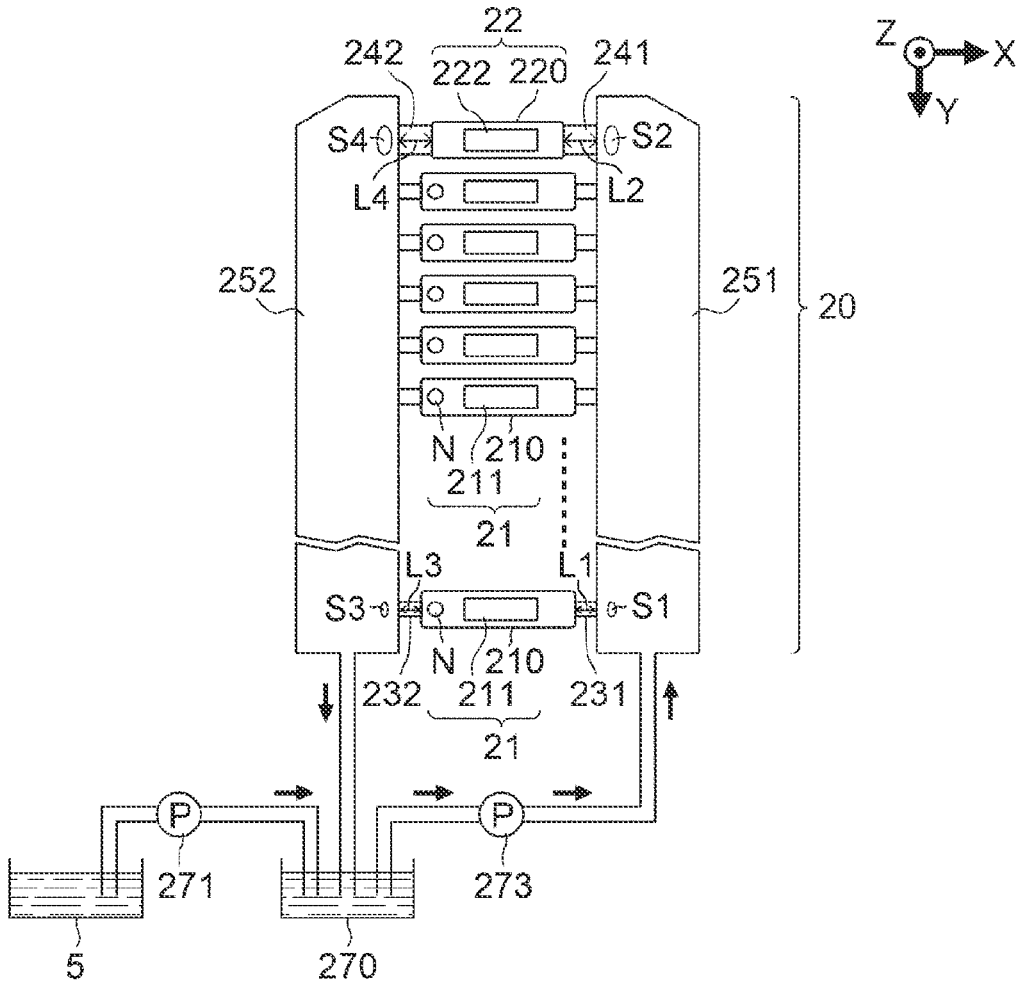
FIG. 3 illustrates the structures of a print head and like in the liquid ejecting apparatus.

FIG. 3 illustrates the structure of the print head 20 together with ink supply routes and the like. A pump 271 sucks ink held in the liquid container 5 and transfers the sucked ink to a tank 270 through an ink supply tube. A pump 273 transfers, to a common flow path 251 provided in the print head 20, the ink transferred to the tank 270. Since the pressure of ink in the common flow path 251 increasing by the pump 273 is different from the pressure of ink in the common flow path 252, the ink in the flow path 251 flows to the flow path 252 through the individual flow paths 231 and 232 or the individual flow paths 241 and 242.

The print head 20 includes the common flow path 251, another common flow path 252, m liquid discharge sections 21, and one pressure vibration section 22.

The common flow paths 251 and 252 are provided for the m liquid discharge sections 21 and one pressure vibration section 22 in common.

The common flow path 251 is a flow path, provided in common, along which the ink transferred by the pump 273 is supplied to the liquid discharge sections 21 or pressure vibration section 22. The common flow path 252 is a flow path, provided in common, along which ink is discharged from the liquid discharge sections 21 or pressure vibration section 22 to the tank 270.

Each liquid discharge section 21 includes a pressure chamber 210, a piezoelectric element 211, and a nozzle N. A total of m nozzles N in the m liquid discharge sections 21 are arranged in a row so as to be spaced at substantially equal intervals in the Y direction. Individual flow paths 231 and 232 are provided in one-to-one correspondence with the m liquid discharge sections 21. The ink transferred to the common flow path 251 is caused to flow to the pressure chamber 210 in each liquid discharge section 21 along the relevant individual flow path 231 and is then discharged to the common flow path 252 along the relevant individual flow path 232.

The pressure vibration section 22 includes a pressure chamber 220 and the piezoelectric element 222. Individual flow paths 241 and 242 are attached to the pressure vibration section 22. The ink transferred to the common flow path 251 is caused to flow to the pressure chamber 220 in the pressure vibration section 22 along the individual flow path 241 and is then discharged to the common flow path 252 along the individual flow path 242.

The ink discharged to the common flow path 252 is returned to the tank 270.

In this structure, ink that has not been discharged from the nozzle N is circulated by the pump 273 on a route starting at the tank 270, passing along the common flow path 251, individual flow path 231, liquid discharge section 21, individual flow path 232, and common flow path 252 in this order, and returning to the tank 270. The ink supplied to the pressure vibration section 22 is circulated on a route starting at the tank 270, passing along the common flow path 251, individual flow path 241, pressure vibration section 22, individual flow path 242, and common flow path 252 in this order, and returning to the tank 270.

In FIG. 3, the X direction, Y direction, and Z direction are the same as in FIG. 1 only for the print head 20, and are not applicable to the ink supply routes to the print head 20 and the ink supply routes from the print head 20.

The piezoelectric elements 211 and 222, which have equivalent structures, are displaced according to the applied voltage. When the piezoelectric elements 211 and 222 undergo displacement, they generate an electromotive force corresponding to the displacement. That is, the piezoelectric elements 211 and piezoelectric element 222 are actuators displaced according to the applied voltage, and are also sensors that generate an electromotive force corresponding to the displacement.

After ink has been discharged from the nozzle N, vibration occurs in the pressure chamber 210 according to an amount of returned protruded ink. This type of vibration is also referred to as residual vibration because the vibration remains after discharging. Residual vibration is attenuated according to the viscosity of ink.

Therefore, the viscosity of ink can be inferred by detecting residual vibration and then analyzing the waveform of the detected residual vibration. When the viscosity of ink filled in a pressure chamber is determined, the waveform of the discharging driving signal at the time of discharging ink, for example, can be appropriately controlled according to the viscosity. Under this type of control, the amount of ink to be discharged can be expected to be maintained at a substantially fixed amount regardless of a change in viscosity (a change in temperature).

The pressure vibration section 22 that detects a signal generated by an electromotive force corresponding to a change in residual vibration, the signal indicating the residual vibration, preferably has a structure different from a structure that discharges ink, that is, the structure of the liquid discharge section 21 including the nozzle N and pressure chamber 210.

This is because a structure including the nozzle N may cause a problem such as clogging due to dried ink or foreign matter but a structure free of the nozzle N does not cause such a problem.

Another problem is that when ink has high viscosity, residual vibration is extremely rapidly attenuated or almost no vibration occurs, so a structure similar to the structure of the liquid discharge section 21 makes it difficult to analyze residual vibration.

Accordingly, in this embodiment, attention was focused on the shape (specifically, length and cross-sectional area) of the individual flow path 241, which is disposed between the common flow path 251 and the pressure chamber 220 in the pressure vibration section 22 and leads ink to the pressure chamber 220, and on the shape (specifically, length and cross-sectional area) of the individual flow path 242, which is disposed between the common flow path 252 and the pressure chamber 220 in the pressure vibration section 22 and leads ink to the common flow path 252.

Specifically, the shape of the individual flow path 241 was made different from the shape of the individual flow path 231, which is disposed between the common flow path 251 and the pressure chamber 210 in the liquid discharge section 21 and leads ink to the pressure chamber 210. Furthermore, the shape of the individual flow path 242 was made different from the shape of the individual flow path 232, which is disposed between the common flow path 252 and the pressure chamber 210 in the liquid discharge section 21 and leads ink to the common flow path 252. More specifically, the viscous resistances of the individual flow path 241 and individual flow path 242 were made lower than the viscous resistances of the individual flow path 231 and individual flow path 232 so that even when the viscosity of ink is high, residual vibration generated in the pressure chamber 220 in the pressure vibration section 22 is not rapidly attenuated.

Generally, when pressure is applied to a flow path, an example of which is a circular tube, filled with a liquid (fluid) such as an ink, an inertial resistance M exerted due to the pressure is represented by equation (1) below.

$$M=\mu L/(\pi r^2) \tag{1}$$

As indicated in equation (1), the inertial resistance M is proportional to the length L of the circular tube and is inversely proportional to the square of the radius r of the circular tube. In equation (1), p is the specific gravity of the liquid.

The viscous resistance R of the circular tube is represented by equation (2), the viscous resistance R being exerted due to the viscosity of the liquid in the above case.

$$R=8\ \mu L/(\pi r^4) \tag{2}$$

In equation (2), μ is the viscosity of the liquid. The viscous resistance R is inversely proportional to the fourth power of the radius r of the circular tube. Although not particularly indicated, even when the flow path is not a circular tube but a square tube, substantially the same tendency exists.

Noting the viscosity μ, equation (2) can be rewritten as equation (3).

$$\mu=R\times\pi r^4/8L \tag{3}$$

To make the viscous resistance of the individual flow path 241 lower than the viscous resistance of the individual flow path 231, it is sufficient to make the cross-sectional area of the individual flow path 241 larger than the cross-sectional area of the individual flow path 231. To make the viscous resistance of the individual flow path 242 lower than the viscous resistance of the individual flow path 232, it is sufficient to make the cross-sectional area of the individual flow path 242 larger than the cross-sectional area of the individual flow path 232.

In the liquid discharge section 21, therefore, even when, for example, ink having high viscosity extremely rapidly attenuates residual vibration and this makes it difficult to analyze residual vibration, the attenuation of residual vibration in the pressure vibration section 22 is slower than in the liquid discharge section 21. This makes it possible to analyze residual vibration.

Although the nozzle N is formed in the liquid discharge section 21, the pressure vibration section 22 lacks the nozzle N. Vibration generated in the liquid discharge section 21 has a natural vibration cycle determined by the shapes and sizes of the nozzle N and pressure chamber 210, the weight of ink filled in the pressure chamber 210, and other factors. Vibration generated in the pressure vibration section 22 has a natural vibration cycle determined by the shape and size of the pressure chamber 220, the weight of ink filled in the pressure chamber 220, and other factors. Therefore, when the lengths of the individual flow paths 241 and 242 having a larger cross-sectional area than the individual flow paths 231 and 232 are shorter than or equal to the lengths of the individual flow paths 231 and 232, the natural vibration cycle of the liquid discharge section 21 differs from the natural vibration cycle of the pressure vibration section 22 by an amount corresponding to an inertance equivalent to the nozzle N. In view of this, the inertial resistances of the individual flow path 241 and individual flow path 242 are adjusted so that the liquid discharge section 21 and pressure vibration section 22 have essentially the same natural vibration cycle. Specifically, to adjust the inertial resistances of the individual flow path 241 and individual flow path 242, the lengths of the individual flow path 241 and individual flow path 242 are adjusted so that the liquid discharge section 21 and pressure vibration section 22 have essentially the same natural vibration cycle. In this embodiment, the individual flow path 241 has a longer length than the individual flow path 231 and the individual flow path 242 has a longer length than the individual flow path 232.

When the liquid discharge section 21 and pressure vibration section 22 have essentially the same natural vibration cycle, this indicates that the natural vibration cycle of the pressure vibration section 22 is within the range from 0.8 to 1.2 times or preferably from 0.9 to 1.1 times the average natural vibration cycle of the liquid discharge section 21. Alternatively, when the liquid discharge section 21 and pressure vibration section 22 have essentially the same natural vibration cycle, this indicates that the natural vibration cycle of the pressure vibration section 22 is within variations of the natural vibration cycle of the liquid discharge section 21.

Specifically, as illustrated in FIG. 3, the cross-sectional area S2 of the individual flow path 241 between the common flow path 251 and the pressure chamber 220 in the pressure vibration section 22 is larger than the cross-sectional area S1 of the individual flow path 231 between the common flow path 251 and the pressure chamber 210 in the liquid discharge section 21, and the length L2 of the individual flow path 241 is longer than the length L1 of the individual flow path 231. Similarly, the cross-sectional area S4 of the individual flow path 242 is larger than the cross-sectional area S3 of the individual flow path 232, and the length L4 of the individual flow path 242 is longer than the length L3 of the individual flow path 232.

When the shape of the individual flow path 241 is such that the cross-sectional area varies in the flow path between the common flow path 251 and the pressure chamber 220, the cross-sectional area S2 of the individual flow path 241 is the minimum cross-sectional area in the flow path between the common flow path 251 and the pressure chamber 220. Similarly, when the shape of the individual flow path 242 is such that the cross-sectional area varies in the flow path between the common flow path 252 and the pressure chamber 220, the cross-sectional area S4 of the individual flow path 242 is the minimum cross-sectional area in the flow path between the common flow path 252 and the pressure chamber 220.

The cross-sectional area of a flow path is the area obtained when the flow path is cut perpendicular to the direction in which the liquid flows. In the example in FIG. 3, ink, which is an example of a liquid, flows in the direction opposite to the X direction in the individual flow path 231, 241, 232, or 242. Therefore, the cross-sectional area of the individual flow path 231, 241, 232, or 242 is the cross-sectional area obtained when the individual flow path 231, 241, 232, or 242 is cut in the Y direction.

Figure 4:
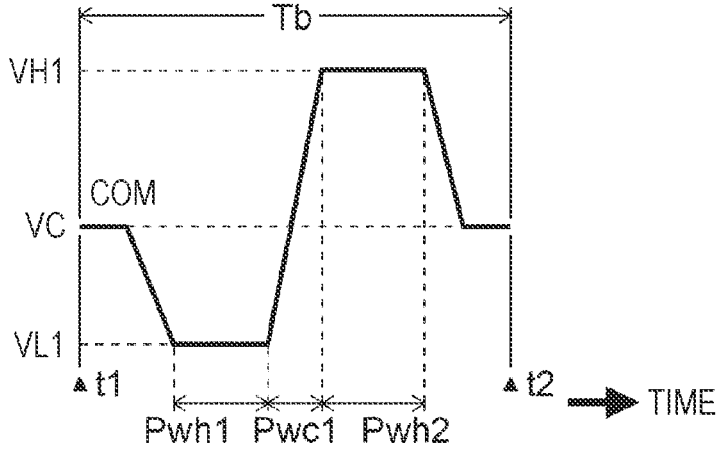
FIG. 4 illustrates an example of a discharging driving signal.

FIG. 4 illustrates an example of the waveform of the discharging driving signal COM.

The discharging driving signal COM has a repeating waveform in which trapezoids repeatedly appear in such a way that at time t1 at which a print cycle Tb starts, the discharging driving signal COM is at a voltage Vc, after which the voltage of the discharging driving signal COM drops from Vc to VL1, rises from VL1 to VH1, and drops from VH1 to Vc. Finally, the discharging driving signal COM reaches time t2 at which the print cycle Tb is terminated.

This discharging driving signal COM is a signal by which when, for example, the switch circuit 281 is switched on and the discharging driving signal COM is applied to one of the electrodes of the piezoelectric element 211, ink is discharged from the nozzle N in the liquid discharge section 21 including the piezoelectric element 211.

Specifically, when the voltage of the discharging driving signal COM drops from Vc to VL1, the piezoelectric element 211 is displaced in a direction in which the inner volume of the pressure chamber 210 is increased and ink is thereby sucked into the pressure chamber 210 due to the displacement. The voltage VL1 of the discharging driving signal COM is kept constant in a period Pwh1. When the voltage of the discharging driving signal COM then rises from VL1 to VH1 in a period Pwc1, the piezoelectric element 211 is displaced in a direction in which the inner volume of the pressure chamber 210 is reduced and the ink sucked into the pressure chamber 210 is thereby discharged from the nozzle N due to the displacement. The voltage VH1 of the discharging driving signal COM is kept constant in a period Pwh2. When the voltage of the discharging driving signal COM then drops from VH1 to Vc, the piezoelectric element 211 is displaced in a direction in which the inner volume of the pressure chamber 210 is increased, specifically so that the state at time t1 is restored.

When the switch circuit 281 is switched off, the discharging driving signal COM is not applied to the one electrode of the piezoelectric element 211, and accordingly, the piezoelectric element 211 is not displaced. In this case, ink is not discharged from the nozzle N in the liquid discharge section 21 including the piezoelectric element 211.

When the repeating waveform of the discharging driving signal COM continues to be applied to the one electrode of the piezoelectric element 211, ink is discharged from the nozzle N corresponding to the piezoelectric element 211 in each print cycle Tb. Since the print head 20 moves in the main scanning direction during image formation, the print cycle Tb determines the minimum interval in the main scanning direction in a dot array formed on the medium Pa as the result of ink being discharged.

Figure 5:
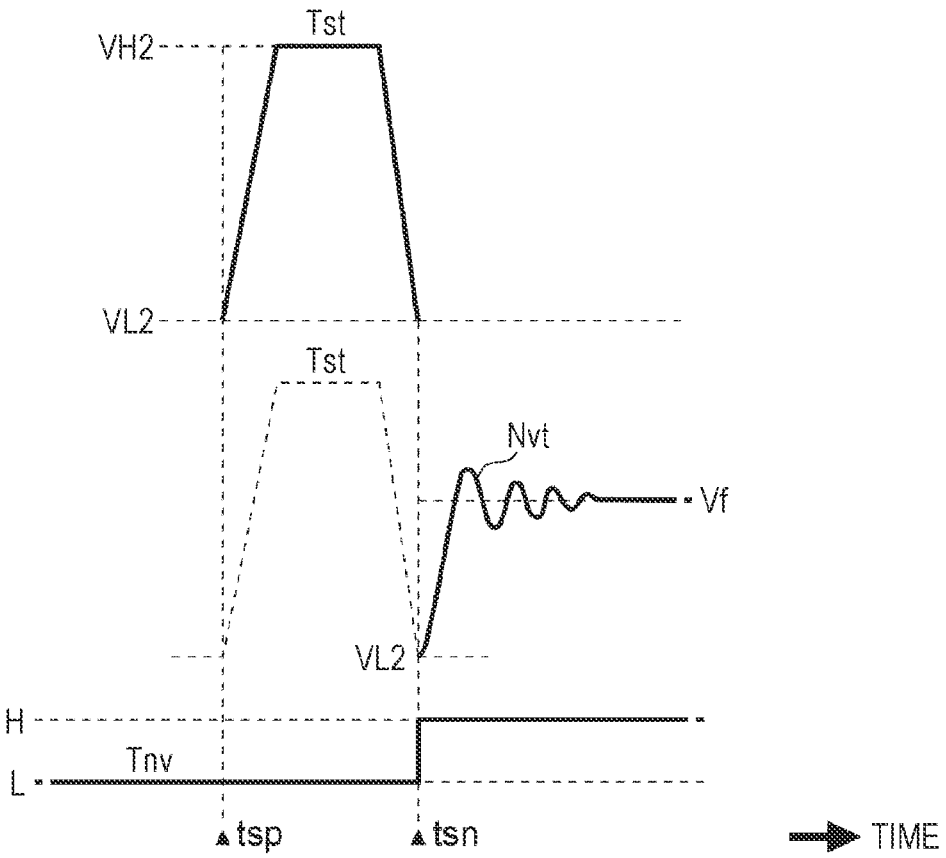

FIG. 5 illustrates examples of the waveform of the detection driving signal Tst, the waveform of the detection signal Nvt, and the like.

In this embodiment, the detection driving signal Tst has a one-shot pulse waveform, as an example, the voltage of which starts to rise from VL2 at time tsp, rises to VH2, and drops to VL2 at time tsn.

The signal Tnv that specifies a start of the detection of residual vibration changes from low to high at time tsn. Since the signal Tnv is at the low level until it reaches time tsn, the switch circuit 282 selects the contact "a". According to this selection, the detection driving signal Tst is applied to one electrode of the piezoelectric element 222, by which vibration which results in residual vibration is induced in the pressure chamber 220 in the pressure vibration section 22. In this embodiment, since the pressure vibration section 22 lacks the nozzle N, even when vibration is induced in the pressure chamber 220, ink is not discharged.

When the signal Inv changes to the high level at time tsn, the switch circuit 282 switches the selection from the contact "a" to the contact "b". In the pressure chamber 220, displacement due to residual vibration causes the piezoelectric element 222 to generate an electromotive force, after which the detection signal Nvt having a voltage corresponding to the displacement is output.

The vibration detection section 130 analyzes the voltage waveform of the detection signal Nvt as described below to obtain the viscosity of ink.

Figure 6:
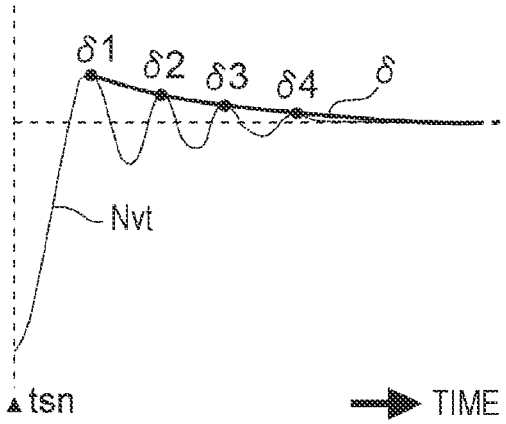
FIG. 6 illustrates an example of the waveform of a detection signal.

FIG. 6 illustrates an example of the voltage waveform of the detection signal Nvt.

After time tsn, the detection signal Nvt is attenuated according to the viscosity and converges to a specific voltage (in the drawing, Vf).

The vibration detection section 130 sets peak points on this type of attenuating waveform as δ1, δ2, δ3, . . . in chronological order. The vibration detection section 130 then approximates a bold solid line δ obtained by linking these peak points by using an exponential function such as equation (4) below and obtains λ.

$$\delta = x\, e^{-\lambda t} \tag{4}$$

Here, λ can be represented by equation (5) below.

$$\lambda = R/(2M) \tag{5}$$

The inertial resistance M exerted on the flow path can be obtained from the specific gravity ρ of the liquid and the dimensions of the flow path, as indicated by equation (1).

The viscous resistance R of the flow path can be obtained from equation (6) below, which results from rewriting equation (5).

$$R = 2M\lambda \tag{6}$$

When the inertial resistance M obtained from equation (1) and λ obtained by the approximating exponential function are substituted into equation (6), the viscous resistance R is obtained.

When the obtained R and the dimensions of the flow path are substituted into equation (2), the viscosity μ of the liquid can be obtained.

Specifically, the vibration detection section 130 obtains λ by approximating the voltage waveform of the detection signal Nvt to the exponential function indicated by equation (4). The vibration detection section 130 also obtains the inertial resistance M by using equation (1). The vibration detection section 130 then substitutes the obtained λ and inertial resistance M into equation (6) to obtain the viscous resistance R of the flow path. Finally, the vibration detection section 130 substitutes the obtained viscous resistance R and the dimensions of the flow path into equation (3) to obtain the viscosity μ of the liquid.

When the viscosity μ of the liquid is comparatively low, it is possible to manage to obtain the viscosity μ of the liquid from the dimensions of the flow path and the detection result from the piezoelectric element 211 in the liquid discharge section 21, as described above. Specifically, the viscosity μ of the liquid can be obtained according to a detection signal output from the piezoelectric element 211 when residual vibration generated in the pressure chamber 210 in the liquid discharge section 21 is detected by the piezoelectric element 211.

Figure 7:
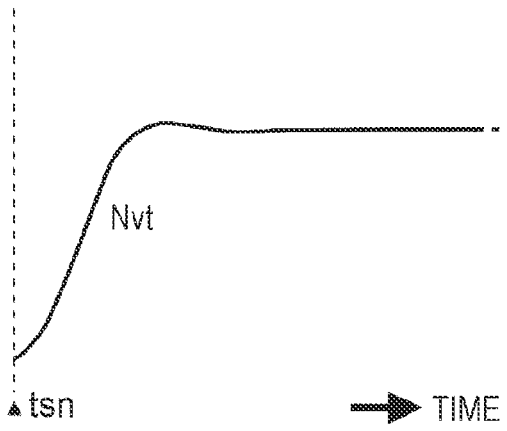
FIG. 7 illustrates another example of the waveform of the detection signal.
Figure 8:
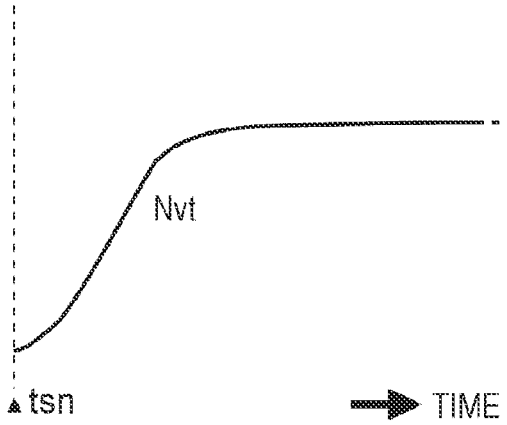
FIG. 8 illustrates another example of the waveform of the detection signal.

In this structure, however, when the viscosity μ of the liquid is high, the waveform of the detection signal output from the piezoelectric element 211 is rapidly attenuated as illustrated in, for example, FIG. 7. This makes it impossible to accurately obtain peak coordinates. When the viscosity μ of the liquid is higher, peak coordinates may not appear as illustrated in, for example, FIG. 8.

Therefore, the above structure has been problematic in that the viscosity of a liquid can be obtained only when the viscosity is low.

In this embodiment, however, the pressure vibration section 22 is provided separately from the liquid discharge section 21. In addition, to make the viscous resistance of the individual flow path 241 lower than the viscous resistance of the individual flow path 231, the cross-sectional area S2 of the individual flow path 241 extending from the common flow path 251 to the pressure chamber 220 in the pressure vibration section 22 is larger than the cross-sectional area S1 of the individual flow path 231 extending from the common flow path 251 to the pressure chamber 210 in the liquid discharge section 21. In this embodiment, this suppresses the attenuation of residual vibration, so even when the viscosity μ of the liquid is high, the viscosity μ can be obtained.

In this embodiment, when the vibration detection section 130 obtains the viscosity μ of the liquid, the vibration detection section 130 transmits information indicating the viscosity μ to the control section 100. Then, the control section 100 corrects waveform data Dc according to the viscosity μ. Specifically, the control section 100 corrects the periods Pwh1, Pwc1 and Pwh2, the voltages Vc, VL1 and VH1, the print cycle Tb, and the like at the time of conversion to analog form, according to the viscosity μ. Alternatively, the control section 100 may be structured so that it divides values of the viscosity μ into ranges and stores a plurality of waveform data items Dc, each of which corresponds to one of these ranges, in advance, selects waveform data corresponding to the range of the viscosity μ, the range being indicated by the information transmitted from the vibration detection section 130, and transmits the waveform data to the discharging driving signal generation section 115 to cause it to generate the discharging driving signal COM so as to have a waveform corresponding to the viscosity μ.

Figure 9:
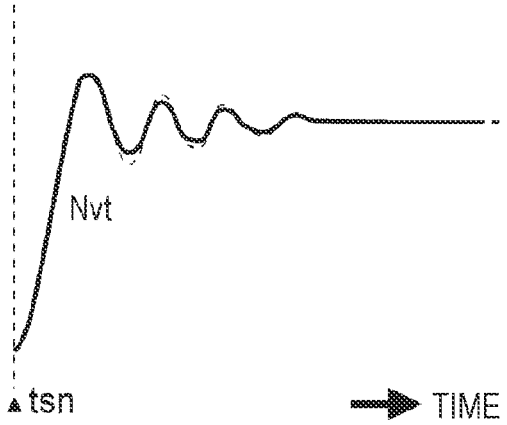
FIG. 9 illustrates another example of the waveform of the detection signal.

Although, in this embodiment, the pressure vibration section 22 lacks the nozzle N, the pressure vibration section 22 may have the nozzle N. FIG. 9 illustrates an example of the waveform of the detection signal Nvt with a solid line when the pressure vibration section 22 has the nozzle N. It is found that the waveform of the detection signal Nvt when the pressure vibration section 22 has the nozzle N is adaptable even when the viscosity is high, in spite of the waveform having a slightly smaller amplitude than the waveform of the detection signal Nvt when the pressure vibration section 22 lacks the nozzle N (the waveform is indicated by the broken line in FIG. 9).

In the structure in which the pressure vibration section 22 has the nozzle N, however, the nozzle N may cause a problem such as clogging due to dried ink or foreign matter. From the opposite viewpoint, the structure in which the pressure vibration section 22 lacks the nozzle N can suppress this problem.

Even in the structure in which the pressure vibration section 22 lacks the nozzle N, when the lengths of the individual flow paths 241 and 242 in the pressure vibration section 22 are adjusted to lengths corresponding to the inertance equivalent to the nozzle N in the liquid discharge section 21, the liquid discharge section 21 and pressure vibration section 22 have essentially the same natural vibration cycle.

Generally, the shape of the waveform of the discharging driving signal COM to be applied to the liquid discharge section 21 is set in relation to the natural vibration cycle of the liquid discharge section 21. Therefore, the shape of the waveform of the discharging driving signal COM to be applied to the liquid discharge section 21 can be corrected according to the detection signal Nvt indicating residual vibration in the pressure vibration section 22.

Second Embodiment

In the structure illustrated in FIG. 3 in the first embodiment, the length L4 of the individual flow path 242 has been longer than the length L3 of the individual flow path 232 and the length L2 of the individual flow path 241 has been longer than the length L1 of the individual flow path 231 so that the liquid discharge section 21 having the nozzle N and the pressure vibration section 22 lacking the nozzle N have essentially the same natural vibration cycle. However, this is not a limitation.

As described in the first embodiment, the shorter the length L of the circular tube (flow path) is, the smaller the viscous resistance R is, and the larger the cross-sectional area of the circular tube (flow path) is, the smaller the viscous resistance R, as indicated by equation (2). Therefore, even when the cross-sectional area S2 of the individual flow path 241 and the cross-sectional area S4 of the individual flow path 242 are smaller than or equal to the cross-sectional area S1 of the individual flow path 231 and the cross-sectional area S3 of the individual flow path 232, the viscous resistance R of the pressure vibration section 22 can be made lower than the viscous resistance R of the liquid discharge section 21 by making at least one of the length L2 of the individual flow path 241 and the length L4 of the individual flow path 242 shorter than the length L1 of the individual flow path 231 and the length L3 of the individual flow path 232. In addition, even when the length L2 of the individual flow path 241 and the length L4 of the individual flow path 242 are longer than or equal to the length L1 of the individual flow path 231 and the length L3 of the individual flow path 232, the viscous resistance R of the pressure vibration section 22 can be made lower than the viscous resistance R of the liquid discharge section 21 by making at least one of the cross-sectional area S2 of the individual flow path 241 and the cross-sectional area S4 of the individual flow path 242 larger than the cross-sectional area S1 of the individual flow path 231 and the cross-sectional area S3 of the individual flow path 232.

Even when the liquid discharge section 21 having the nozzle N and pressure vibration section 22 lacking the nozzle N do not have essentially the same natural vibration cycle, by making the viscous resistance R of the pressure vibration section 22 smaller than the viscous resistance R of the liquid discharge section 21, it is possible to prevent residual vibration generated in the pressure chamber 220 in the pressure vibration section 22 from being rapidly attenuated. This enables analysis of residual vibration even when ink has high viscosity, in which case residual vibration generated in the pressure chamber 210 in the liquid discharge section 21 otherwise would be rapidly attenuated and thereby analysis of residual vibration would be not possible.

In view of this, a second embodiment, in which the liquid discharge section 21 having the nozzle N and the pressure vibration section 22 lacking the nozzle N do not have essentially the same natural vibration cycle, will be described next.

Although, in the first embodiment, the common flow path 252 has been provided to circulate ink, the common flow path 252 may be eliminated.

Figure 10:
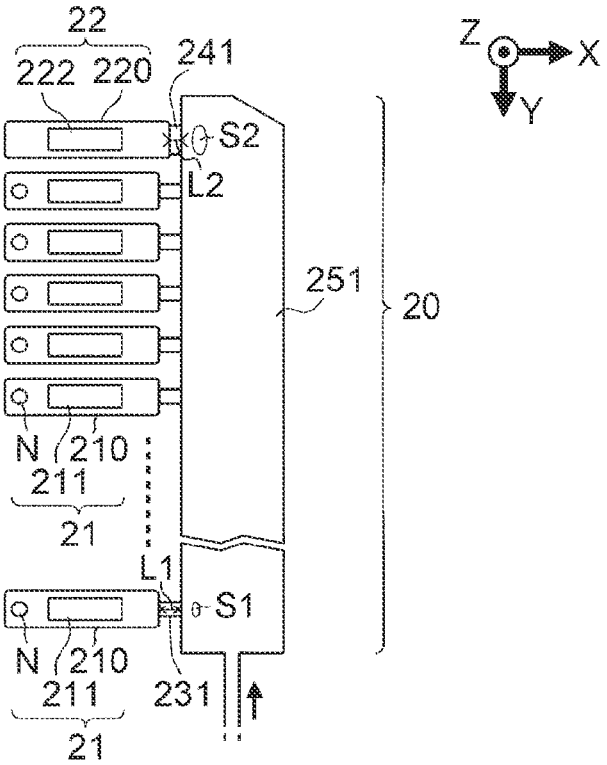
FIG. 10 illustrates an example the structure of the print head in a liquid ejecting apparatus in a second embodiment.

FIG. 10 illustrates the structure of the print head 20 applied to the liquid ejecting apparatus 1 in the second embodiment.

As illustrated in the drawing, the print head 20 is structured so that the common flow path 252 is eliminated, the cross-sectional area S2 of the individual flow path 241 is larger than the cross-sectional area S1 of the individual flow path 231, and the length L2 of the individual flow path 241 is shorter than the length L1 of the individual flow path 231.

In the structure in FIG. 10, because the common flow path 252 is eliminated, the individual flow paths 232 and 242 are also eliminated.

Figure 11:
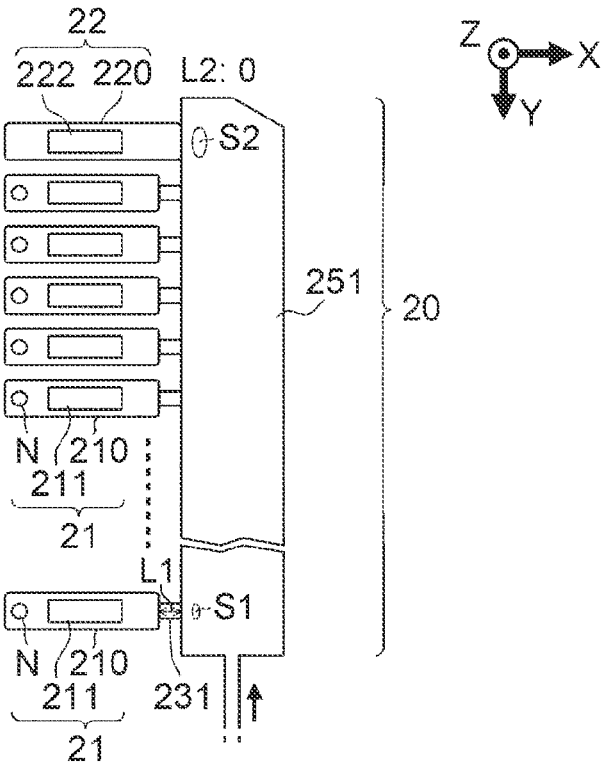
FIG. 11 illustrates a variation of the print head.

As a structure in which the length L2 of the individual flow path 241 is shorter than the length L1 of the individual flow path 231, an aspect in which the length L2 is zero as illustrated in FIG. 11 is also included.

Although not illustrated, when the common flow path 252 is provided in the second embodiment to circulate ink as in the first embodiment, the cross-sectional area S4 of the individual flow path 242 may be larger than the cross-sectional area S3 of the individual flow path 232 or the length L4 of the individual flow path 242 may be shorter than the length L3 of the individual flow path 232. As a structure in which the length L4 of the individual flow path 242 is shorter than the length L3 of the individual flow path 232, an aspect in which the length L4 is zero is also included.

When the common flow path 252, along which ink is circulated, is provided in the second embodiment as described above, at least one of the cross-sectional areas of the individual flow paths 241 and 242 is larger than the cross-sectional areas of the individual flow paths 231 and 232 or at least one of the lengths of the individual flow paths 241 and 242 is shorter than the lengths of the individual flow paths 231 and 232.

It is also possible both to make at least one of the cross-sectional areas of the individual flow paths 241 and 242 larger than the cross-sectional areas of the individual flow paths 231 and 232 and to make at least one of the lengths of the individual flow paths 241 and 242 shorter than the lengths of the individual flow paths 231 and 232.

Variations

Many variations are possible on the embodiments described above. Specifically, variations or applications described below are possible. Any two or more aspects selected from the exemplary examples described below can also be combined.

Variation 1

In the structure illustrated in FIG. 3 in the first embodiment, the length L4 of the individual flow path 242 has been longer than the length L3 of the individual flow path 232, and the length L2 of the individual flow path 241 has been longer than the length L1 of the individual flow path 231 so that the liquid discharge section 21 having the nozzle N and the pressure vibration section 22 lacking the nozzle N have essentially the same natural vibration cycle. However, this is not a limitation. For example, only one of the lengths of the individual flow paths 241 and 242 may be made longer than the lengths of the individual flow paths 231 and 232 to make the liquid discharge section 21 and pressure vibration section 22 have essentially the same the natural vibration cycle.

In addition, in the structure illustrated in FIG. 3, the cross-sectional area S4 of the individual flow path 242 has been larger than the cross-sectional area S3 of the individual flow path 232, and the cross-sectional area S2 of the individual flow path 241 has been larger than the cross-sectional area S1 of the individual flow path 231 so that the liquid discharge section 21 and pressure vibration section 22 have essentially the same natural vibration cycle. However, this is not a limitation. For example, only one of the cross-sectional areas of the individual flow paths 241 and 242 may be made larger than the cross-sectional areas of the individual flow paths 231 and 232 so that the liquid discharge section 21 and pressure vibration section 22 have essentially the same the natural vibration cycle.

Figure 12:
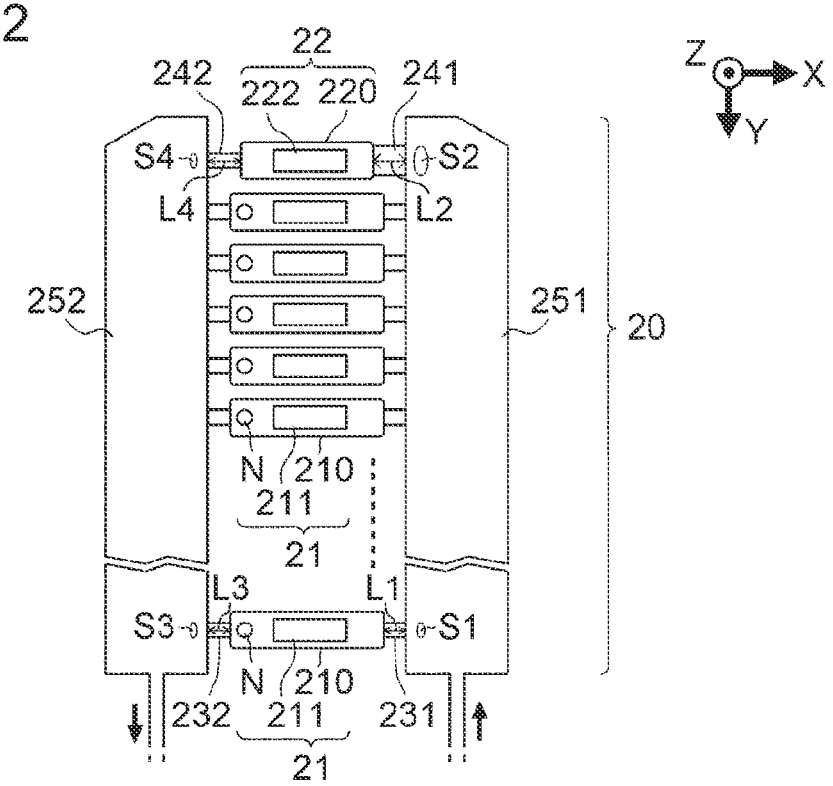
FIG. 12 illustrates another variation of the print head.

FIG. 12 illustrates an example of a structure in which only the cross-sectional area S2 of the individual flow path 241 is larger than the cross-sectional area S1 of the individual flow path 231.

In addition, to make the individual flow path 241 have a smaller viscous resistance than the individual flow path 231, the cross-sectional area S2 of the individual flow path 241 may be larger than the cross-sectional area S1 of the individual flow path 231 or the cross-sectional area S4 of the individual flow path 242 may be larger than the cross-sectional area S3 of the individual flow path 232, and the length L2 of the individual flow path 241 and the length L1 of the individual flow path 231 may be substantially the same.

Figure 13:
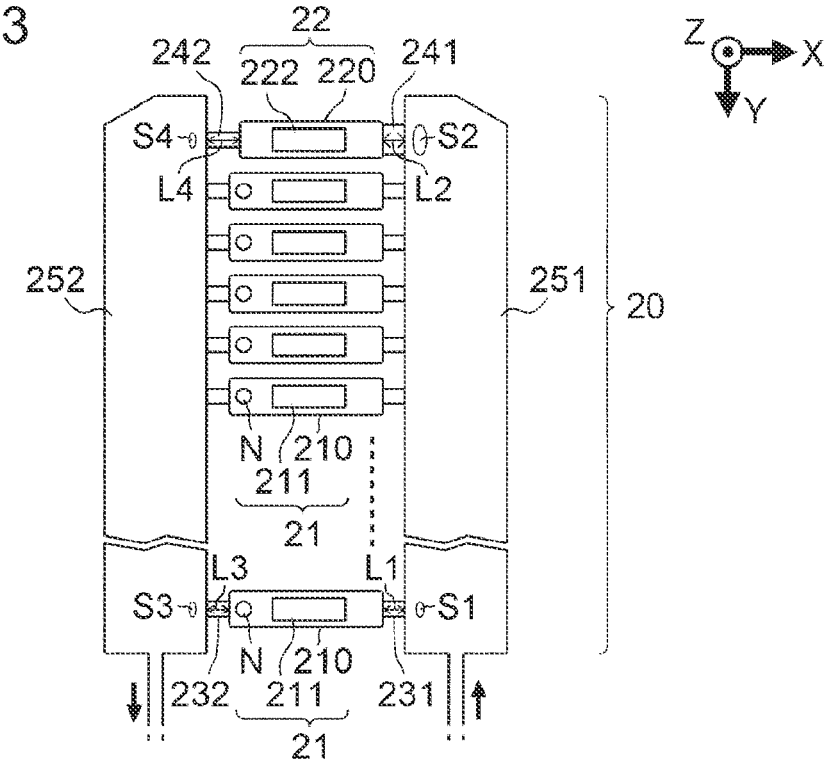
FIG. 13 illustrates another variation of the print head.

FIG. 13 illustrates an example of a structure in which while the cross-sectional area S4 of the individual flow path 242 and the cross-sectional area S3 of the individual flow path 232 are substantially the same, the cross-sectional area S2 of the individual flow path 241 is larger than the cross-sectional area S1 of the individual flow path 231 and the length L2 of the individual flow path 241 and the length L1 of the individual flow path 231 are substantially the same.

Variation 2

In the first embodiment, the length L2 of the individual flow path 241 has been longer than the length L1 of the individual flow path 231 and the length L4 of the individual flow path 242 has been longer than the length L3 of the individual flow path 232 so that the liquid discharge section 21 having the nozzle N and the pressure vibration section 22 lacking the nozzle N have essentially the same natural vibration cycle. However, this is not a limitation.

Figure 14:
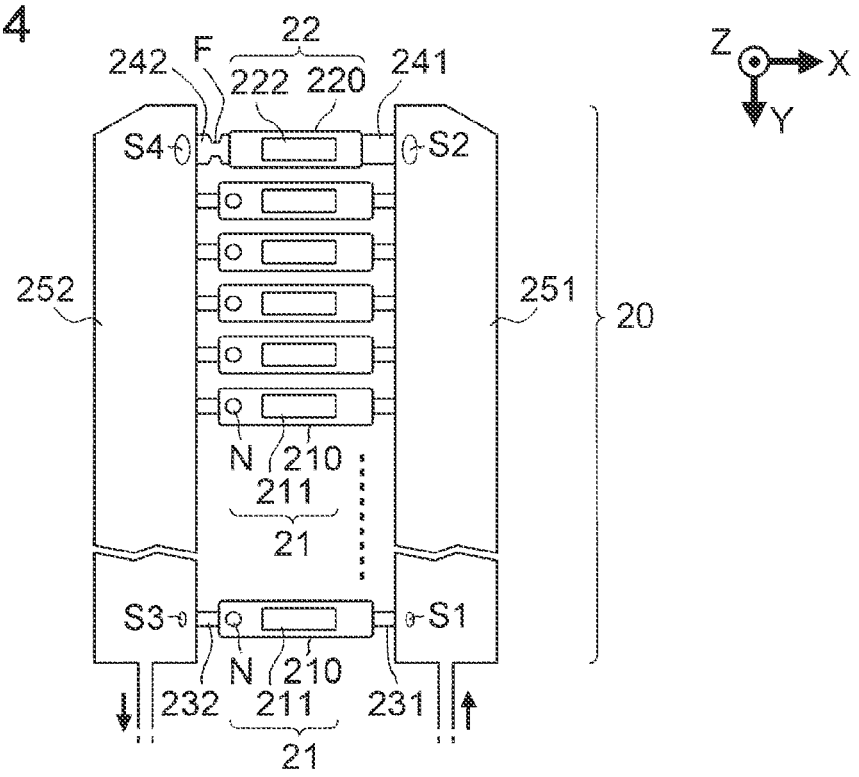
FIG. 14 illustrates another variation of the print head.

In a structure in which the common flow path 252 is provided to circulate ink as in the first embodiment, a restricting portion F that provides an inertance equivalent to the nozzle N in the liquid discharge section 21 may be attached to the individual flow path 242 disposed between the common flow path 252 and the pressure chamber 220 in the pressure vibration section 22 as illustrated in, for example, FIG. 14 to generate a difference in pressure. By adjusting the cross-sectional area and length of the restricting portion F, the natural vibration cycle of the liquid discharge section 21 having the nozzle N and the natural vibration cycle of the pressure vibration section 22 lacking the nozzle N can be made to approach each other.

Figure 15:
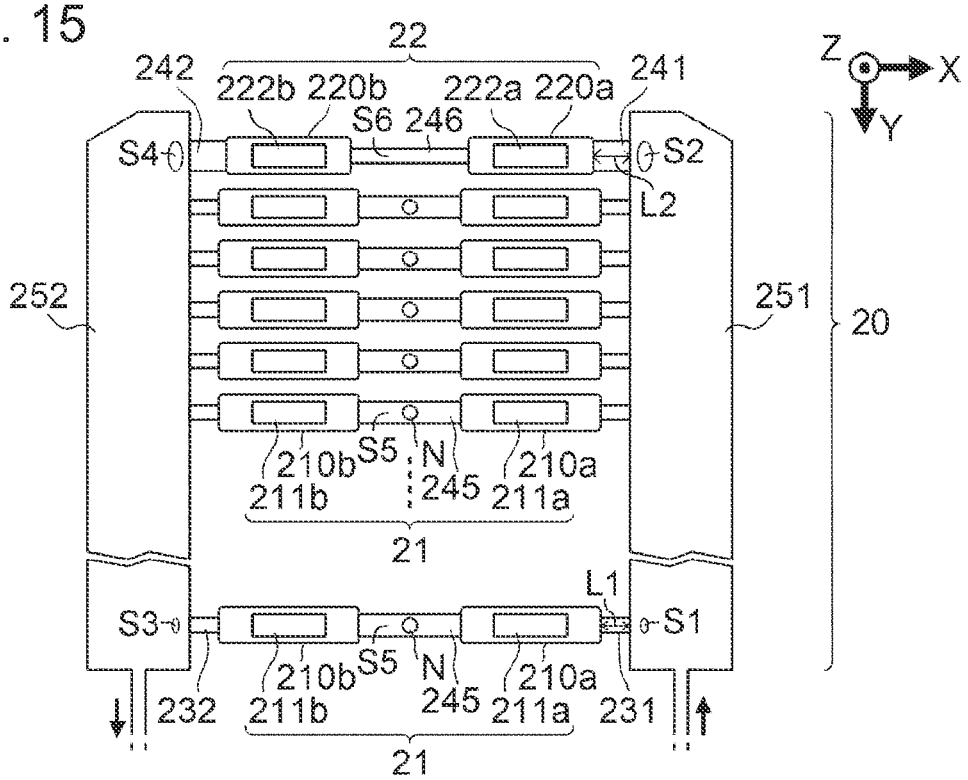
FIG. 15 illustrates another variation of the print head.

Another example of the structure is illustrated in FIG. 15. In this structure, the liquid discharge section 21 includes one nozzle N, a pair of a pressure chamber 210*a* and an piezoelectric element 211*a*, and a pair of a pressure chamber 210*b* and an piezoelectric element 211*b*; the pressure chambers 210*a* and 210*b* are linked through a linking flow path 245; and the nozzle N is disposed substantially at the center of the linking flow path 245 in the X direction.

In the example of the structure in FIG. 15, the pressure vibration section 22 includes a pair of a pressure chamber 220*a* and an piezoelectric element 222*a* and a pair of a pressure chamber 220*b* and an piezoelectric element 222*b*; and the pressure chambers 220*a* and 220*b* are linked through a linking flow path 246.

In the structure in FIG. 15, an inertance equivalent to the nozzle N in the liquid discharge section 21 can be provided in the pressure vibration section 22 by making the cross-sectional area S6 of the linking flow path 246 smaller than the cross-sectional area S5 of the linking flow path 245. The cross-sectional area of part of the linking flow path 246 can be made small. When the cross-sectional area S6 of at least part of the linking flow path 246 and at least part of its length are adjusted, the natural vibration cycle of the liquid discharge section 21 having the nozzle N and the natural vibration cycle of the pressure vibration section 22 lacking the nozzle N can be made to approach each other.

In this structure, even when the pressure vibration section 22 has a lower viscous resistance than the liquid discharge section 21, it is possible to make the behavior of ink in the pressure chamber 220 in the pressure vibration section 22 lacking the nozzle N more approach the behavior of ink in the pressure chamber 210 in the liquid discharge section 21.

Variation 3

Figure 16:
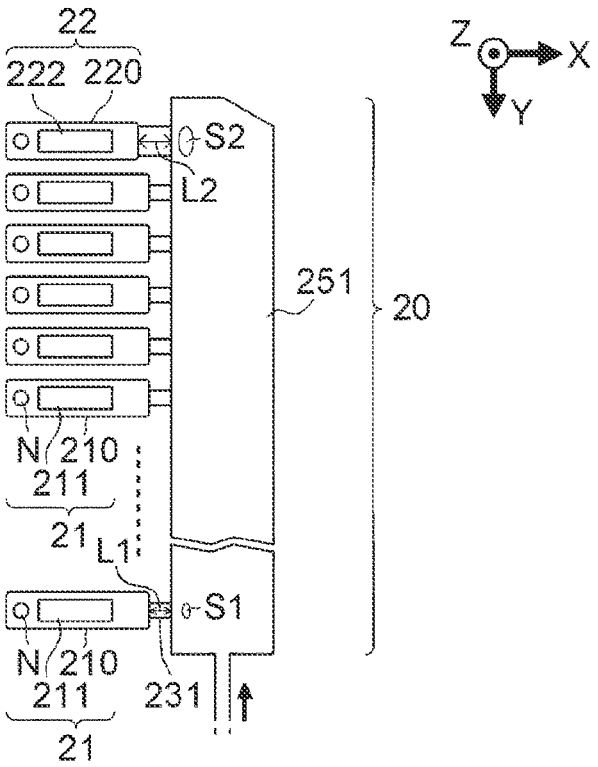
FIG. 16 illustrates another variation of the print head.

Although, in the embodiments described above, the pressure vibration section 22 has lacked a nozzle, this is not a limitation. For example, it is also possible for the pressure vibration section 22 to have a nozzle. Particularly, in a structure in which ink is not circulated as illustrated in FIG. 16, when a nozzle is formed in the pressure vibration section 22, the initial filling of ink can be eased. In this structure, after the initial filling of ink, the nozzle may be closed.

In the structure in which ink is not circulated, there is the possibility that ink only in the pressure vibration section 22 is not discharged, so the state of ink in the pressure vibration section 22 differs from the state of ink in the liquid discharge section 21 with the elapse of time. To prevent this, a structure is also possible in which a nozzle is formed in the pressure vibration section 22 as well to refresh ink filled in the pressure chamber 220 in the pressure vibration section 22 as in the liquid discharge section 21.

Variation 4

Although, in the embodiments described above, one pressure vibration section 22 has been provided in the print head 20, this is not a limitation. It is also possible to provide a plurality of pressure vibration sections 22 in the print head 20.

The pressure chamber 210 is an example of a first pressure chamber, and the pressure chamber 220 is an example of a second pressure chamber. The piezoelectric element 211 is an example of a first piezoelectric element, and the piezoelectric element 222 is an example of a second piezoelectric element. The common flow path 251 is an example of a first common flow path, and the common flow path 252 is an example of a second common flow path.

What is claimed is:

1. A liquid ejecting apparatus comprising:

a liquid discharge section having a first pressure chamber, a first piezoelectric element configured to change an inner volume of the first pressure chamber, and a nozzle communicating with the first pressure chamber;

a pressure vibration section having a second pressure chamber and a second piezoelectric element configured to change an inner volume of the second pressure chamber;

a first common flow path communicating with the first pressure chamber and the second pressure chamber;

a driving signal generation section configured to generate a discharging driving signal to be supplied to the first piezoelectric element and a detection driving signal to be supplied to the second piezoelectric element; and a vibration detection section configured to detect, based on a change in an electromotive force of the second piezoelectric element, residual vibration of a liquid filled in the second pressure chamber, the change occurring after supply of the detection driving signal, wherein a viscous resistance of a flow path between the second pressure chamber and the first common flow path is lower than a viscous resistance of a flow path between the first pressure chamber and the first common flow path.

2. The liquid ejecting apparatus according to claim 1, further comprising a second common flow path communicating with the first pressure chamber and the second pressure chamber, wherein a pressure in the first common flow path and a pressure in the second common flow path are different.

3. The liquid ejecting apparatus according to claim 2, wherein the pressure vibration section does not have a nozzle communicating with the second pressure chamber and a restricting portion is provided between the second pressure chamber and the second common flow path.

4. The liquid ejecting apparatus according to claim 1, wherein the pressure vibration section does not have a nozzle communicating with the second pressure chamber.

5. The liquid ejecting apparatus according to claim 4, wherein a natural vibration cycle of the liquid discharge section is essentiality same as a natural vibration cycle of the pressure vibration section.

6. The liquid ejecting apparatus according to claim 1, wherein the pressure vibration section does not have a nozzle communicating with the second pressure chamber and a length of the flow path between the second pressure chamber and the first common flow path is longer than or equal to a length of the flow path between the first pressure chamber and the first common flow path.

7. The liquid ejecting apparatus according to claim 1, wherein the pressure vibration section does not have a nozzle communicating with the second pressure chamber and a cross-sectional area of the flow path between the second pressure chamber and the first common flow path is smaller than or equal to a cross-sectional area of the flow path between the first pressure chamber and the first common flow path.

* * * * *